United States Patent [19]

Dunn

[11] Patent Number: 4,720,615

[45] Date of Patent: Jan. 19, 1988

[54] INDUCTION SINTERING PROCESS AND APPARATUS

[75] Inventor: Jerry R. Dunn, Boaz, Ala.

[73] Assignee: Tocco, Inc., Boaz, Ala.

[21] Appl. No.: 770,768

[22] Filed: Aug. 29, 1985

[51] Int. Cl.[4] ..... H05B 5/00; H05B 6/00

[52] U.S. Cl. ..... 219/10.41; 219/10.59; 219/10.71; 148/108

[58] Field of Search ..... 219/9.5, 10.41, 10.43, 219/10.59, 10.79, 10.67, 10.69, 10.71; 148/108, 12.9, 154, 103, 147, 150; 29/447; 294/65.5

[56] References Cited

U.S. PATENT DOCUMENTS

| | | | |
|---|---|---|---|
| 2,632,841 | 3/1953 | Wharff, Jr. | 219/10.71 |
| 2,657,301 | 10/1953 | Kincaid et al. | 219/10.71 |
| 2,663,789 | 12/1953 | Redmond | 219/10.71 |
| 3,775,831 | 7/1973 | Cachat | 29/447 |
| 3,854,707 | 12/1974 | Armstrong et al. | 219/10.71 |
| 3,894,892 | 4/1975 | Conta | 148/108 |

*Primary Examiner*—Roy N. Envall, Jr.

*Attorney, Agent, or Firm*—Body, Vickers & Daniels

[57] ABSTRACT

Compacted, unsintered powdered metallurgical workpieces are sequentially shuttled to a series of induction heating units in controlled environments to expel volatile and progressively raise the temperature of the workpiece to an effective sintering temperature.

23 Claims, 12 Drawing Figures

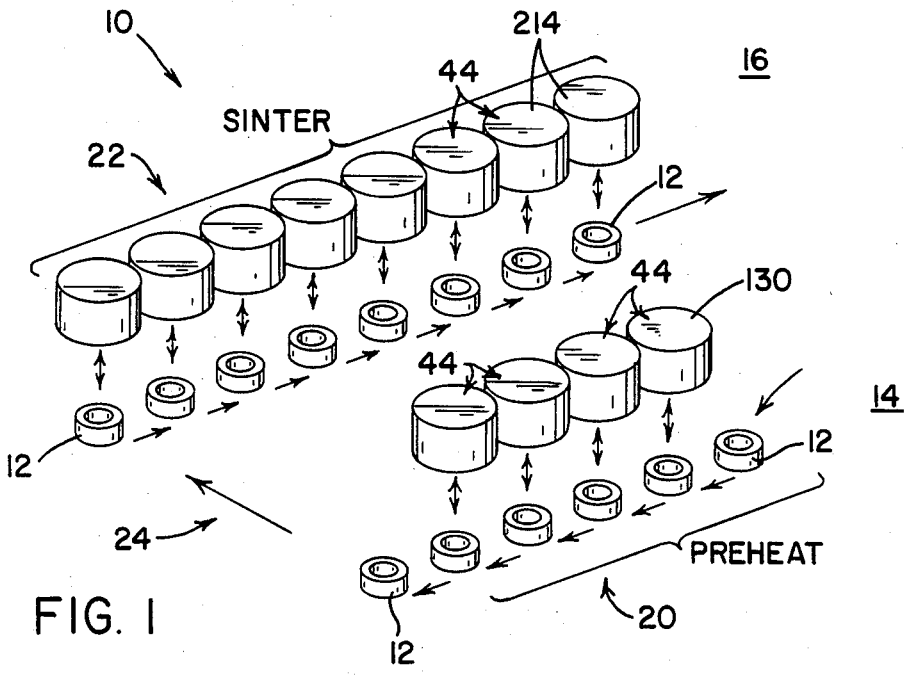
FIG. 1
FIG. 1A
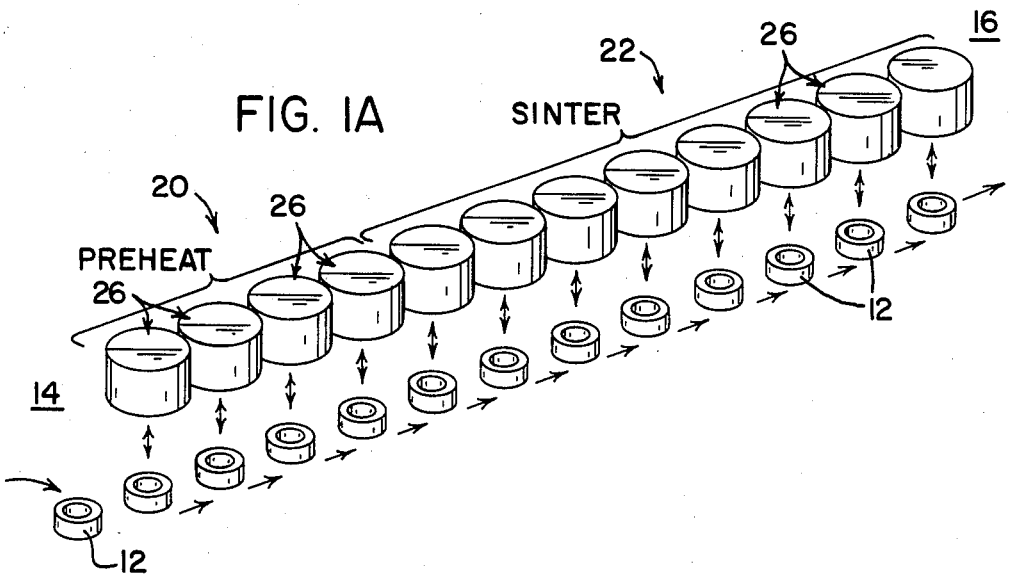

INDUCTION SINTERING PROCESS AND APPARATUS

BACKGROUND OF THE INVENTION

The present invention relates to induction heating, and in particular, to a method and apparatus for sintering powdered metallurgical workpieces using induction heating.

Powdered metallurgical parts are widely used in preference to other manufacture to reduce subsequent sizing and forming operations and to obtain properties not obtainable with conventional materials. Powdered metallurgy finds particular benefits with respect to ferrous parts. Therein, powdered iron, alloying agents, lubricants and additives are homogenously mixed to a controlled particle size and distribution. Thereafter, the powdered composition is compacted or pressed to the shape required for subsequent forming or sizing operations. The green compact or unsintered article is then subjected to controlled heating conditions in a sintering operation for removing of volatile constituents, including die lubricants or waxes, and bind together the particles and impart the desired properties thereto. Such sintering requires accurate control of time, temperature and environment. The sintered parts are then directed to further machining, pressing and other forming and sizing operations.

Conventionally, the sintering operation is conducted in radiant batch-type furnaces or in continuous electrical or fired furnaces. In both types, a suitable non-oxidizing or reducing gas is supplied to maintain the required sintering operation. The radiant and conductive modes are not particularly thermally efficient resulting in heating times which are typically quite long. The batch-type furnace is not amenable to machined paced operation particularly where hot forming operations are required. Therein, the parts must be reheated and fed to the forming operations in accordance with production demand. The continuous furnace, in addition to being quite large and space consuming, has a limited ability to pace sintered production with the hot forming production rate. This oftentimes requires supplemental heating and handling operations. Further, the environmental reducing gas is applied to both the sintering and preheating zones. This can result in contamination of the reducing atmosphere and impairment of product quality. It also requires a gas flow rate sufficient to exhaust the volatiles and to maintain the reducing environment at the requisite purity. Thus, the relatively expensive reducing gas, required only for the actual sintering, is consumed as an effluent effectively preventing recycling and significantly contributing to the processing costs.

BRIEF SUMMARY OF THE INVENTION

The sintering apparatus in accordance with the present invention overcomes the aforementioned limitations while affording significant benefits by providing an apparatus which is compact, may be paced in accordance with downstream production rates, is energy efficient, and accomodates a wide variety of parts. This is accomplished by shuttling the green workpieces through preheating and sintering zones with independently maintained environments, and progressively inductively heating the workpieces under controlled and monitored conditions in a cycle paced with the handling equipment so that heated sintered parts may be directly formed without reheating and rehandling.

More particularly, the preheating zone includes a transfer shuttle having a plurality of workpieces in spaced nests thereon. For the forward stroke of the shuttle, the workpieces are advanced into vertical alignment with a plurality of inductor heaters housed within an exhaust vent. The workpieces are raised simultaneously into heating relationship with the inductor coils of the heaters and inductively heated at a controlled frequency and time to progressively raise the workpieces to a temperature sufficient to expel the workpiece volatiles which are removed by the exhaust vent using ambient air as the carrier. Each coil may be independently powered and monitored to provide for accurate control over the rate of temperature increase and exiting workpiece temperatures. During the heating cycle, the shuttle returns to the retracted position. After heating, the workpieces are lowered on to the shuttle nests and advanced again. This deposits the end workpiece on a cross slide which shifts the preheated workpiece to a shuttle in the sintering zone. In a similar manner, the sintering shuttle advances a plurality of preheated and progressively sintered workpieces into alignment with inductor heaters. The inductors are located in a chamber supplied with the desired environmental atmosphere at a flow rate sufficient to maintain steady state conditions. The workpieces are raised and individually inductively heated under controlled and monitored conditions. During heating, the shuttle is returned to its starting position. The workpieces, after heating, are lowered onto the shuttle which is again advanced depositing the final completely sintered workpiece at an unloading station for automatic or manual transfer to a downstream operation. The processed parts are thus paced through the apparatus, efficiently and controlledly heated in separate preheating and sintering environments, and discharged at a controlled rate, with a minimum handling and at an elevated temperature immediately suitable for further operations.

Accordingly, it is an object of the present invention to provide a machine paced apparatus using progressive induction heating to controlledly sinter powdered metallurgical parts.

Another object of the present invention is to provide a method and apparatus for sequentially advancing powdered metal articles through thermally and environmentally controlled and separate heating zones.

A further object of the present invention is the provision of a compact apparatus for progressively heating workpieces with a minimum of handling under controlled conditions.

Still another object is the provision of a sintering apparatus having reduced processing gas requirements.

BRIEF DESCRIPTION OF THE DRAWINGS

The above and other benefits of the present invention will become apparent upon reading the following description taken in conjunction with the accompanying drawings in which:

FIG. 1 is a schematic view of a sintering apparatus for powdered metallurgical workpieces in accordance with the present invention;

FIG. 1A is a view similar to FIG. 1 of another embodiment of the invention;

DETAILED DESCRIPTION OF THE PREFERRED EMBODIMENT

Figure 2:
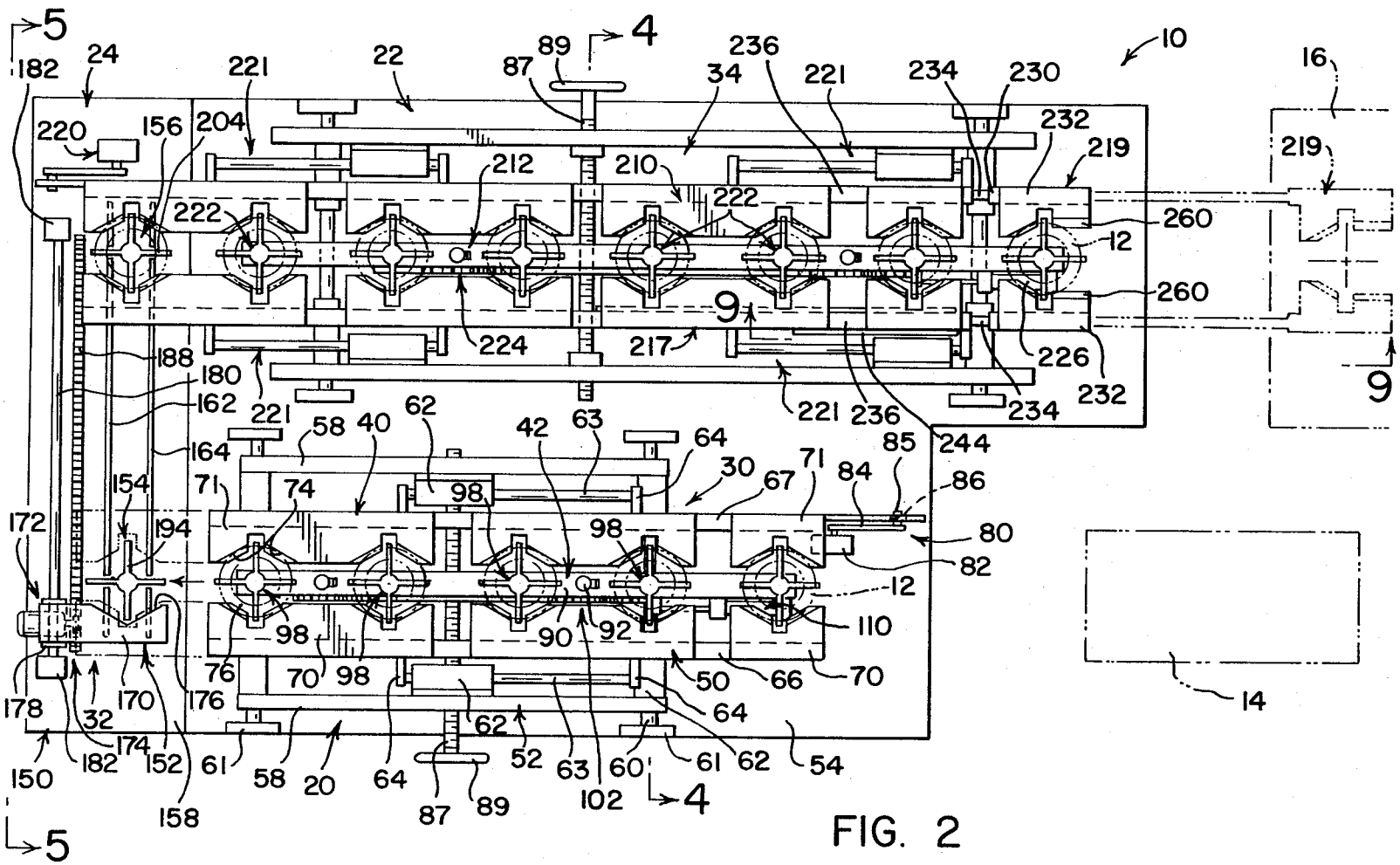
FIG. 2 is a plan view of the sintering apparatus according to the invention.

Referring to the drawings, FIG. 1 schematically illustrates a powdered metallurgy sintering apparatus 10 which receives, automatically or manually, workpieces 12 arriving from an upstream forming operation 14. The apparatus 10 discharges the workpiece 12, manually or automatically to a downstream hot pressing operation 16. The workpieces 12, illustrated as annular hubs, are formed of a particulate composition, the details of which vary in materials and percentages depending on the end use requirements, together with a lubricant such as stearates, paraffins or the like, used to assist the upstream forming operations. To provide the required expulsion of the lubricants and other volatiles and fusing of the particulate, the workpieces are initially heated to a moderate elevated temperature followed by a sintering process at an accurately controlled higher temperature, all dependent in a well known manner on the constituents of the particular workpiece. The apparatus 10 fulfills these requirements by providing a U-shaped heating path including a preheating zone 20 and a sintering zone 22 parallel thereto which are interconnected by a transverse transfer zone 24. Alternatively, as shown in FIG. 1A, the preheating and sintering may be provided in a continuous longitudinal heating path, hereinafter described in greater detail, wherein the workpieces are shuttled through the various zones, and sequentially vertically presented to a series of induction heating units 26.

Figure 3:
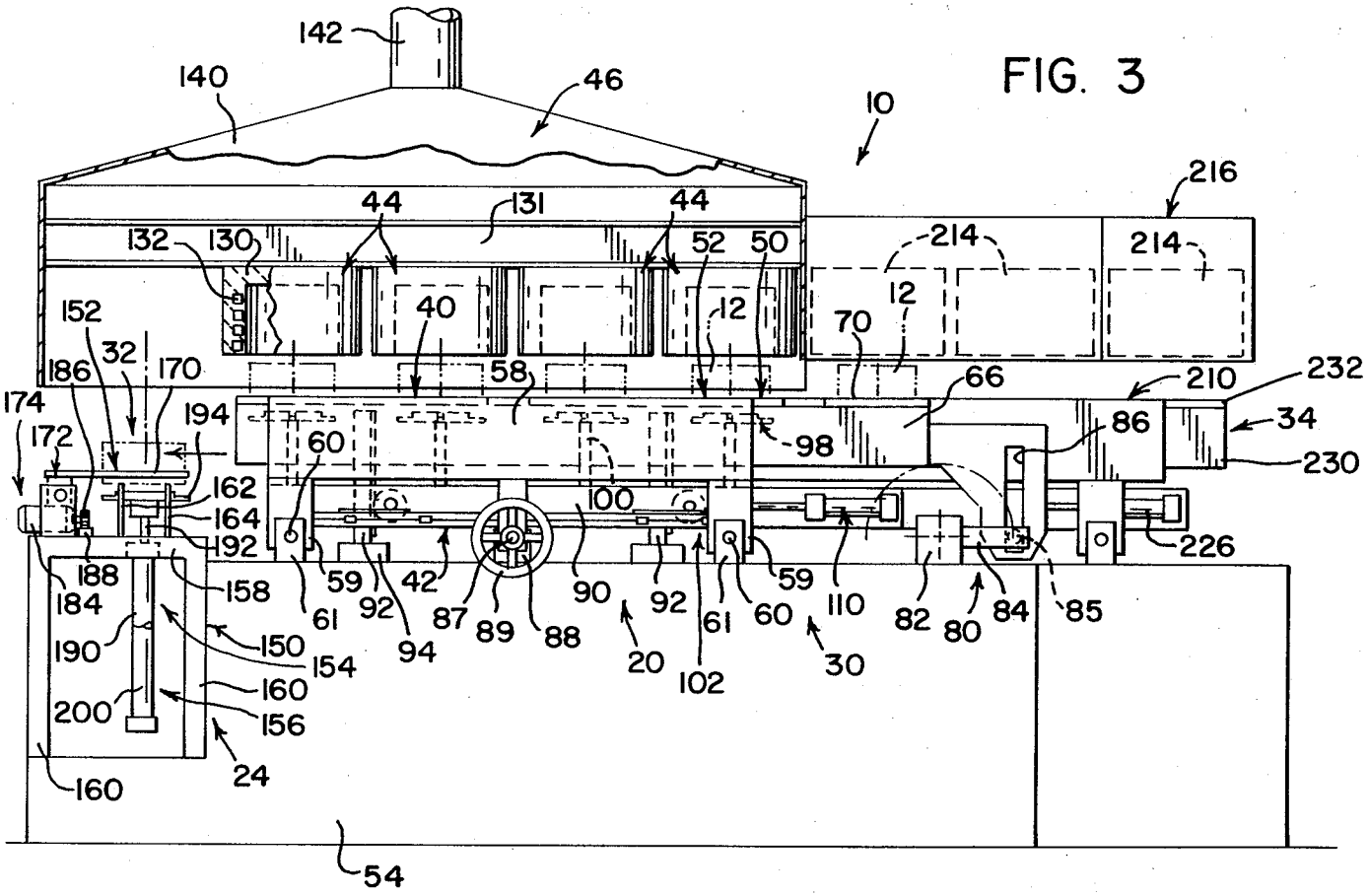
FIG. 3 is a side elevational view of the apparatus of FIG. 2.
Figure 4:
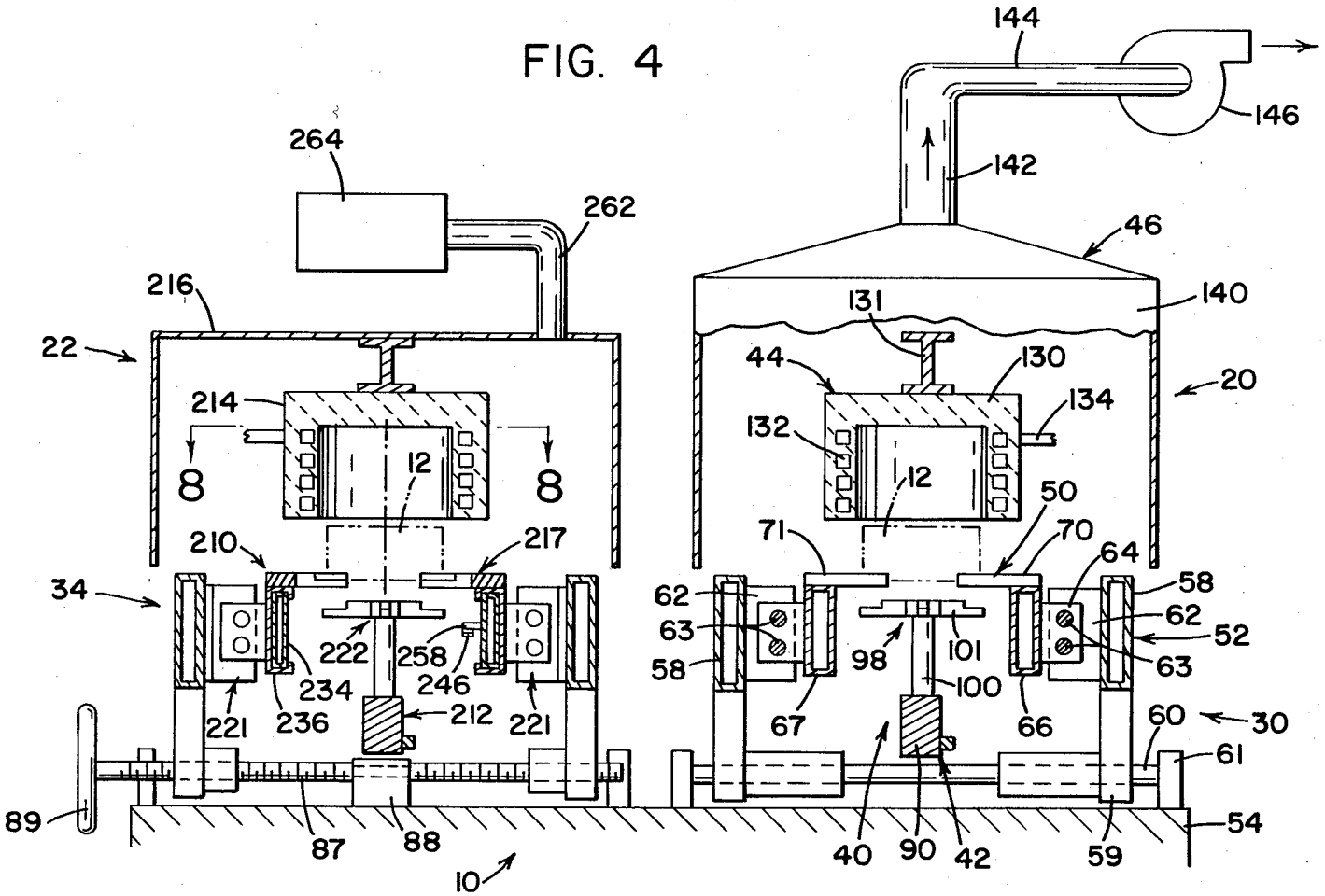
FIG. 4 is a view taken along line 4—4 of FIG. 2.

More particularly, and as shown in FIGS. 2 through 4, the apparatus 10 includes a first shuttle assembly 30 for transferring the workpieces 12 through the preheating zone 20, a cross transfer assembly 32 for transferring the workpieces exiting the preheating zone 20 to the sintering zone 22, and a second shuttle assembly 34 for transferring the workpieces 12 through the sintering zone 22.

The first shuttle assembly 30 generally comprises a longitudinal transfer assembly 40 and a vertical lift assembly 42. Four induction heating units 44 and an exhaust vent 46 are positioned above the shuttle assembly 30.

The transfer assembly 40 includes a shuttle 50 reciprocably supported on a frame 52 connected to a base 54. The shuttle 50 shifts between a rightward position FIG. 3 adjacent to the entry end and a leftward position, shown in dashed lines, partially overlying the transfer zone 24.

The frame 52 includes a pair of laterally spaced tubular side beams 58 having legs 59 transversely slidably supported on transverse tie rods 60, the ends of which are supported by brackets 61 attached to the base 54. A slide block 62 is fixed to the inwardly facing surfaces of the side beams 58. Each slide block 62 is longitudinally apertured for slidably receiving a pair of vertically spaced guide rods 63 fixed at their outer ends to brackets 64 attached to the tubular side beams 66 and 67 of the shuttle 50. A longitudinal series of horizontal support plates 70 and 71 are fixed to the top surfaces of the beams 66 and 67 respectively. The support plates 70 and 71 are transversely spaced to define a central longitudinal opening. Five V-shaped notches defined by recessed shoulders 74 are formed at the inner portions of the plates 70, 71 and uniformly longitudinally spaced therealong. The shoulders 74 define generally square shaped, recessed and apertured workpiece nests. The shoulders 74 also define the peripheral locating surfaces for accurately aligning the workpieces 12 on the nests. The configuration of the nests will vary dependent on the workpiece design.

The shuttle 50 is shifted longitudinally relative to the frame 52 between the positions by means of a rotary actuator 80. The actuator 80 includes a motor 82 mounted on the base 54 having an output crank 84 pivotally connected to a block 85 slidably supported in a vertical slot 86 on the inner surface of the side beam 67. The crank 84 is pivotable counterclockwise approximately 180° between the illustrated rightward position and the leftward position shown in dashed lines. The coaction between the block 85 and the slot 86 shifts the shuttle 50 relative to the frame 52 between the aforementioned positions as accommodated by the slide blocks 62 and guide rods 63. During operation, the actuator 80 is sequenced as hereinafter described. As shown more clearly in FIG. 4, both shuttles are adjustably shifted transversely relative to their frame along the rods 60 by a handwheel assembly including a threaded rod 87 threadably connected to nut blocks 88 connected to the lower surfaces of the shuttle side beams and centrally journaled at a bearing unit 88 connected to the base 54. A handwheel 89 is provided for manually operating the assembly.

The lift assembly 42 is aligned intermediate the frame 52 and aligned with the longitudinal opening between the support plates 70, 71. The lift assembly 42 comprises a lifting bar 90 vertically slidably mounted within vertical bores on a pair of longitudinally spaced support posts 92 having lower flanges 94 attached to the base 54. Four longitudinally spaced lifting pods 98 extend vertically above the top surface of the lifting bar 90. The lifting pods 98 include four posts 100 with four radial spokes 101 that register with the openings in the nests when the shuttle 50 is in the rightward position.

Figure 6:
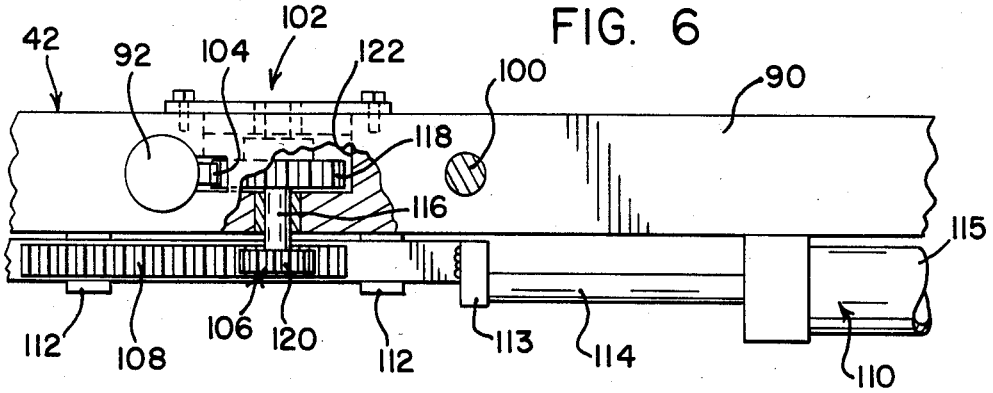
FIG. 6 is a partially sectioned top view of the lift drive for the preheating zone.

The lifting bar 90 is vertically shifted between the illustrated lowered position and a raised heating position, by means of a rack and pinion lift drive unit 102. As shown additionally in FIGS. 6 and 7, the lift drive unit 102 comprises a vertical rack 104, a pinion assembly 106, a horizontal rack 108 and a linear actuator 110. The horizontal rack 108 is slidably supported on the lifting bar 90 by longitudinally spaced brackets 112. The rightward end on the rack 108 is connected by plate 113 to the output shaft 114 of the actuator 110, the cylinder 115 of which is mounted on the right side surface of the lifting bar 90. The actuator 110 drives the rack 108 between the illustrated extended position and a retracted position shown in dashed lines. The vertical rack 104 is suitably connected to each support post 92 and is slidably movable within a vertical channel in the lifting bar 90 adjacent the support post bores. The pinion assembly 106 includes a shaft 116 rotatably supported at a horizontal bore in the lifting bar 90 and supporting an inner pinion 118 and an outer pinion 120. The inner pinion 118 is disposed in a cavity 122 adjacent the support post. The pinion teeth drivingly engage the teeth of the vertical rack 104. The outer pinion 120 is disposed exterior of the lifting bar 90 and has teeth drivingly engaging the teeth of the horizontal rack 108. In operation, shifting of the horizontal rack 108 by the actuator 110 will rotate the outer pinion 120 and the inner pinion 118 which in turn vertically drives the latter and the lifting bar 90 vertically with respect to the vertical rack 104 and the support posts 92. Conjointly the lift pods 98 shift from the illustrated transfer position to the heating position shown in the dashed lines.

Figure 7:
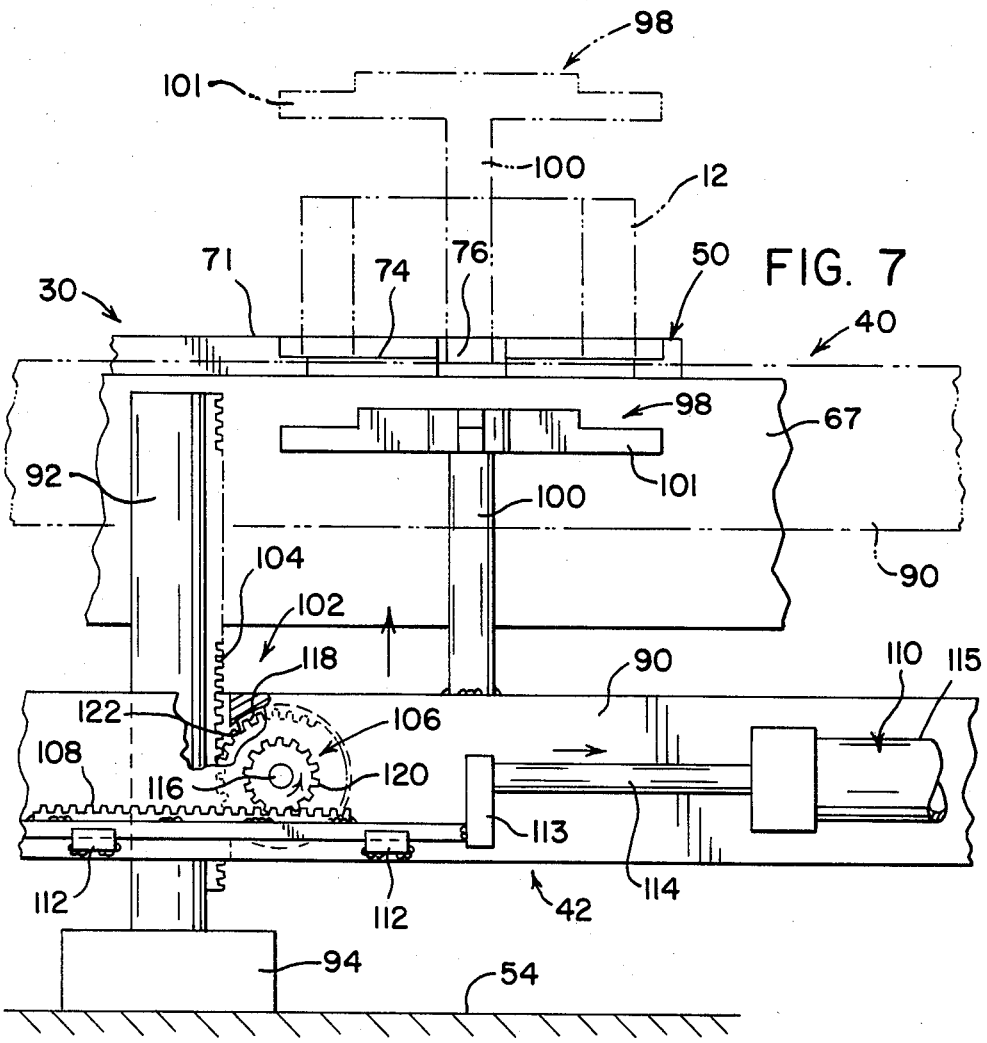
FIG. 7 is a partially sectioned side view of the lift drive shown in FIG. 6.
Figure 8:
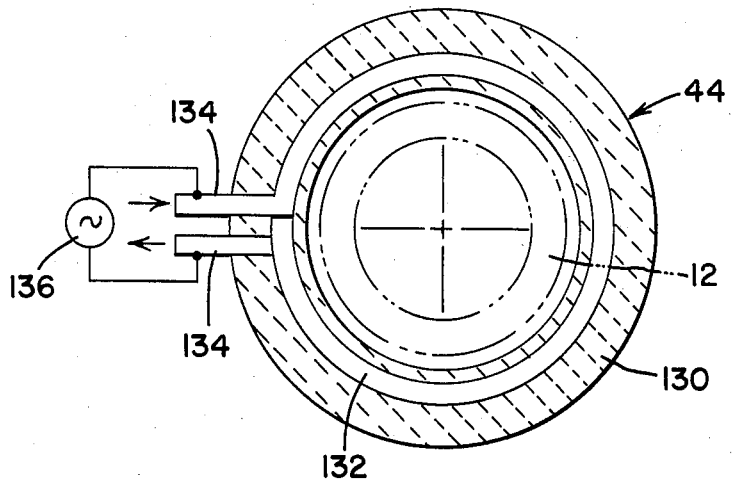
FIG. 8 is a view taken along line 8—8 in FIG. 4.

The induction heating units 44 are mounted in a longitudinal bank and individually vertically aligned with a lifting pod 98. As shown in FIGS. 7 and 8, each unit 44 includes a housing 130 mounted by exterior frame work 131. The housing 130 carries a conventional, multiturn coil 132 having leads 134 connected to a high frequency power supply 136. In the heating position, the inner surface of the coil 132 has a predetermined gap with respect to the presented workpiece to establish an optimum magnetic coupling therebetween. The coil 132 may be a conventional hollow construction, the interior passage of which is supplied with coolant from a suitable source to maintain the operating temperature of the coil within a controlled range.

The exhaust vent 46 is supported on framework, not shown, and includes a hood 140 overlying the heating units 44 and an exhaust 142 conventionally connected by duct 144 with a blower 146 schematically illustrated. The vent 46 is effective for removing volatiles expelled from the workpieces 12 during the preheating operation.

Figure 5:
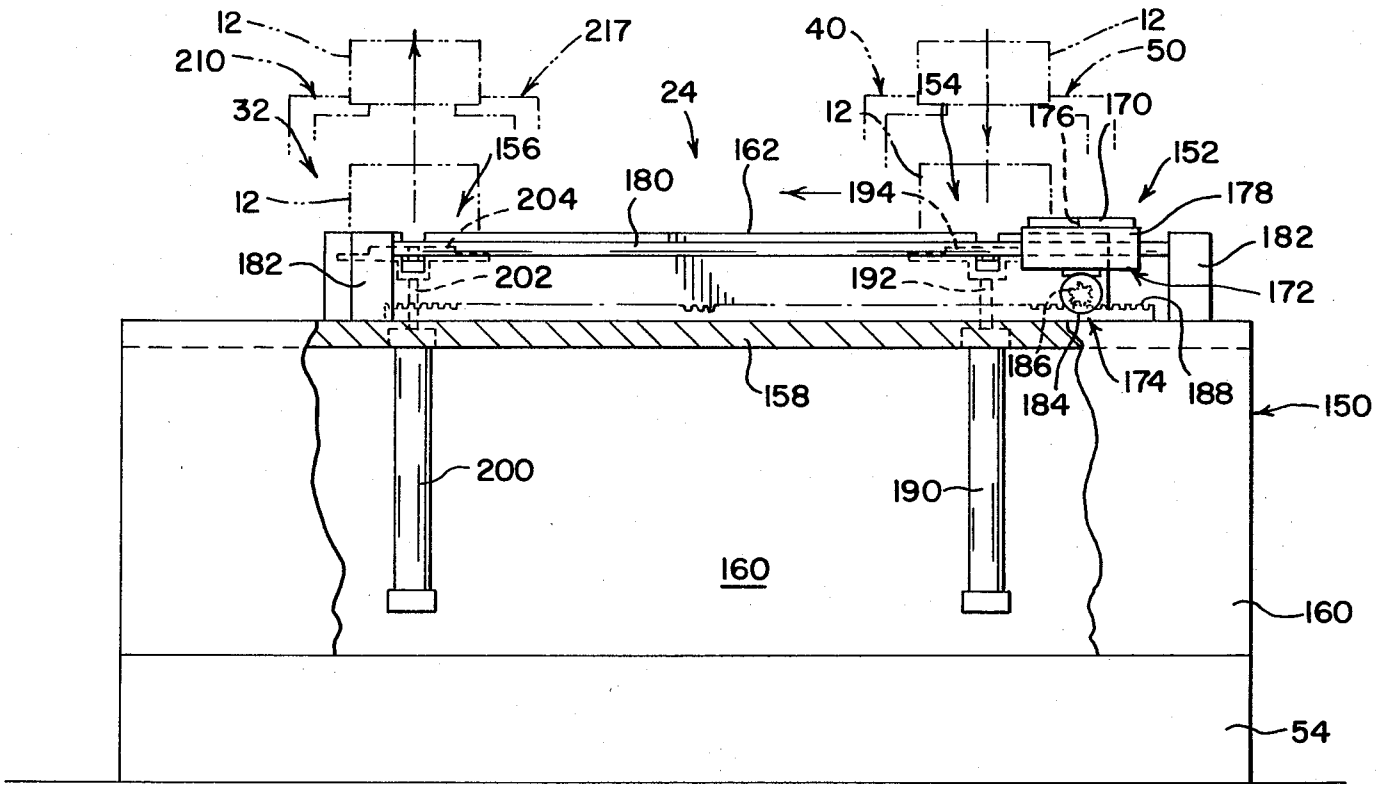
FIG. 5 is a view taken along line 5—5 of FIG. 2.

Referring to FIGS. 2, 3 and 5, the transfer slide assembly 32 is disposed transverse to the preheating zone 20 and the sintering zone 22 and generally comprises a support frame 150, a cross slide 152 and first and second hydraulic lifts 154 and 156, respectively. The support frame 150 includes a horizontal upper support plate 158 connected to laterally spaced legs 160 attached to the base 54.

The support plate 158 includes a pair of transverse rails 162, 164. The first lift 154 is located at the exit end of the hood 140 adjacent the last induction unit in the preheating zone. The second lift 156 is vertically aligned with the initial induction unit in the sintering zone.

The cross slide 152 includes a transfer arm 170 reciprocably mounted on the frame 150 by a slide unit 172 for movement by a rack and pinion drive unit 174 between the illustrated receiving position in the preheating zone and a transfer position, shown in dashed lines, in the sintering zone.

The transfer arm 170 is disposed above the rails 162, 164 parallel to the support plate 158. The arm 170 includes a V-shaped notch 176, the vertical surfaces of which engage the periphery of the workpiece. The slide unit 172 includes a bushing 178 connected to the outer lateral end of the transfer arm 170 that is slidably supported on a horizontal guide bar 180 mounted on the frame 150 by brackets 182. The drive unit 174 comprises a motor 184 having an output pinion 186 connected to the bushing 178 and a rack 188 mounted on the plate 158 and engaged by the pinion 186.

Energization of the motor 184 rotates the pinion 186 to thereby traverse the rack 188 whereby the bushing 178 traverses the guide bar 180 and the transfer arm 170 shifts a workpiece horizontally along the rails 162, 164 between the receiving position and the transfer position.

The first lift 154 includes a vertically disposed linear actuator 190 having an output shaft 192 projecting through an opening in the plate 158 in equally longitudinal spaced relation-with the other unit 98. The shaft carries a spoked lifting pod 194 engageable with the workpieces thereat. The actuator 190 is effective to shift the individual workpieces in succession from the shuttle 50 to a rest position on the slide rails 162, 164 on support plate 158.

The second lift 156 includes a vertically disposed linear actuator 200 having an output shaft 202 projecting through an opening in the plate 158 and carrying a spoked lifting pod 204 engageable with the workpiece thereat. The actuator 200 is effective to shift the workpiece between the transfer position on the rails 162, 164 and the heating position interior of the initial sintering induction unit 214 located at such transfer position.

The sintering shuttle assembly 34 is substantially the same in basic operation and construction as the above-described preheating shuttle assembly and accordingly will be described by reference to its major components and differentiating structure. The assembly 34 comprises a shuttle 210, a lift assembly 212, a bank of induction heating units 214 and an atmosphere controlled chamber 216. The shuttle 210 of the shuttle assembly 34 includes a main shuttle 217 and an extendable end shuttle 219. The shuttle 210 is reciprocated by a rotary actuator 220 between a leftward or retracted position (FIG. 2) and the rightward or advanced position with the end shuttle 219 being in the extended position shown by the dashed lines as accomodated by slide units 221. The lift assembly 212 includes lifting pods 222 and is vertically shifted between raised and lowered positions by rack and pinion drive assembly 224 operated by a linear actuator 226.

Figure 9:
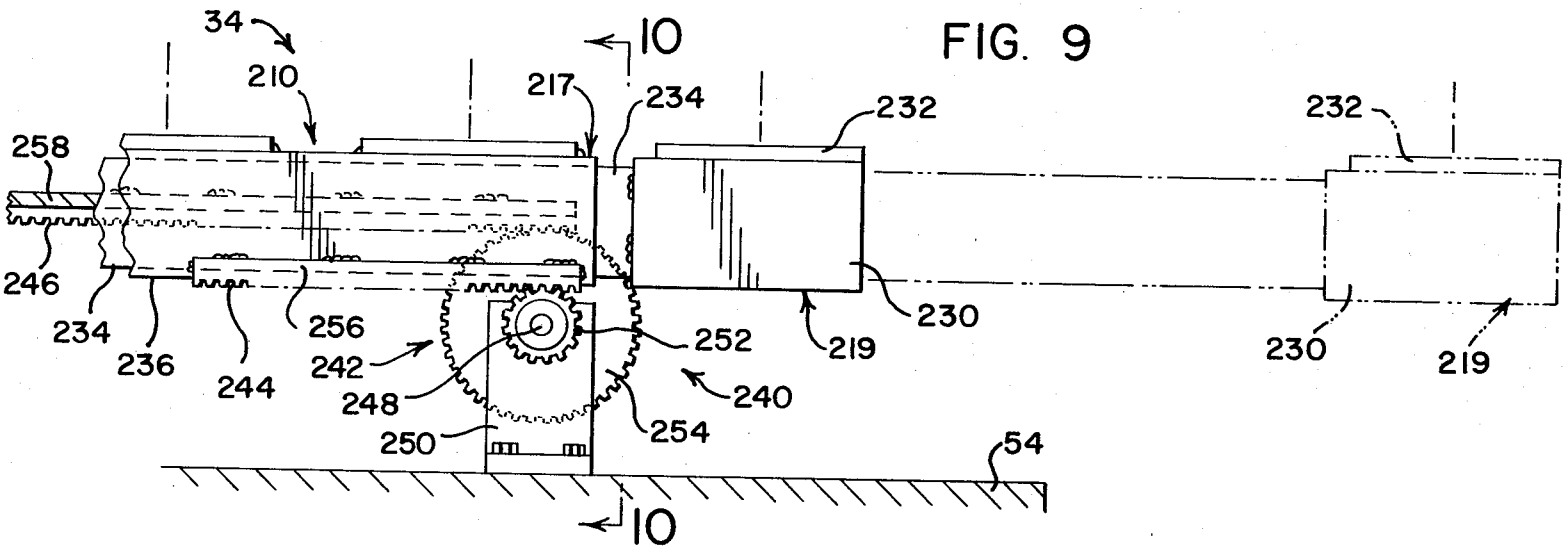
FIG. 9 is a side elevational view of the end shuttle in the sintering zone.
Figure 10:
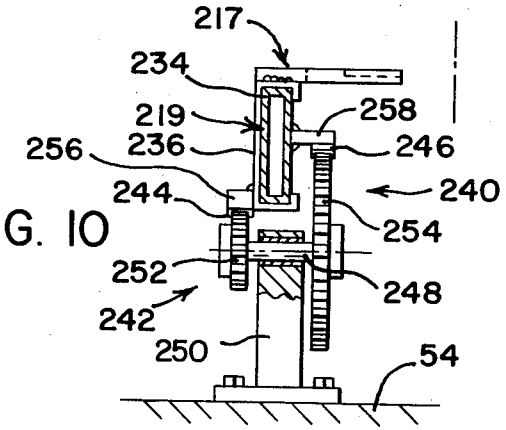
FIG. 10 is a view taken along line 10—10 of FIG. 9.

Referring to FIGS. 9 and 10, the end shuttle 219 is telescopically carried by the main shuttle 217 for movement between the illustrated retracted position and the extended position shown by the dashed lines. More particularly, the end shuttle 219 comprises laterally spaced side beams 230, attached to workpiece support plates 232, and a pair of rectangular support tubes 234 telescopically carried by the side beams 236 of the main shuttle. A double rack and pinion drive unit 240 is effective for extending the end shuttle 219 relative to the main shuttle 217 during rightward movement thereof. The drive unit 240 includes a pinion assembly 242, a drive rack 244 and a driven rack 246. The pinion assembly 242 includes a shaft 248 transversely journaled on a bracket 250 fixed to the base 54, a pinion 252 carried on the outer end of the shaft 248 and a pinion 254 carried on the inner end of the shaft 248. The drive rack 244 is horizontally carried on the side beam 236 of the main shuttle by bracket 256. The driven rack 246 is horizontally carried on the support tube 234 by bracket 258. The teeth of pinion 252 engage the teeth of rack 244. The teeth of pinion 254 engage the teeth of rack 246. Upon rightward movement of the main shuttle 217, the rack 244 rotates the pinion 252 and thereby the pinion 254. The pinion 254 drives the rack 246 and the end shuttle 219 rightwardly relative to the advancing main shuttle at a step-up ratio prescribed by the gearing. The relative movements are reversed during leftward movement of the main shuttle. To facilitate removal of sintered workpieces from the nest of the end shuttle 219 at the unloading station, the outer shoulders 260 of the plates 232 are longitudinally spaced at the width of the workpieces.

The induction heating units 214 are aligned with the lifting pods 222 and the second lift 156 of the transfer assembly 32. The units 214, similar to the units 44, comprise a housing and an inductor coil connected individually or collectively to a high frequency power supply. The inductor coils of units 214 are effective to raise the preheated temperature of the workpieces processed in the preheating zone to an elevated temperature effective to appropriately sinter the material composition of the workpieces. The chamber 216 includes a hood overlying the heating units in the sintering zone. Inasmuch as the sintering preferably takes place in a controlled atmosphere, an appropriate gas such as nitrogen is delivered to the chamber cavity by a fluid line 262 connected to a gas supply 264. Under operating conditions, the flow is such that the sintering zone and the workpieces being inductively heated therein are processed in a controlled environment.

OPERATION OF THE PREFERRED EMBODIMENT

Figure 11:
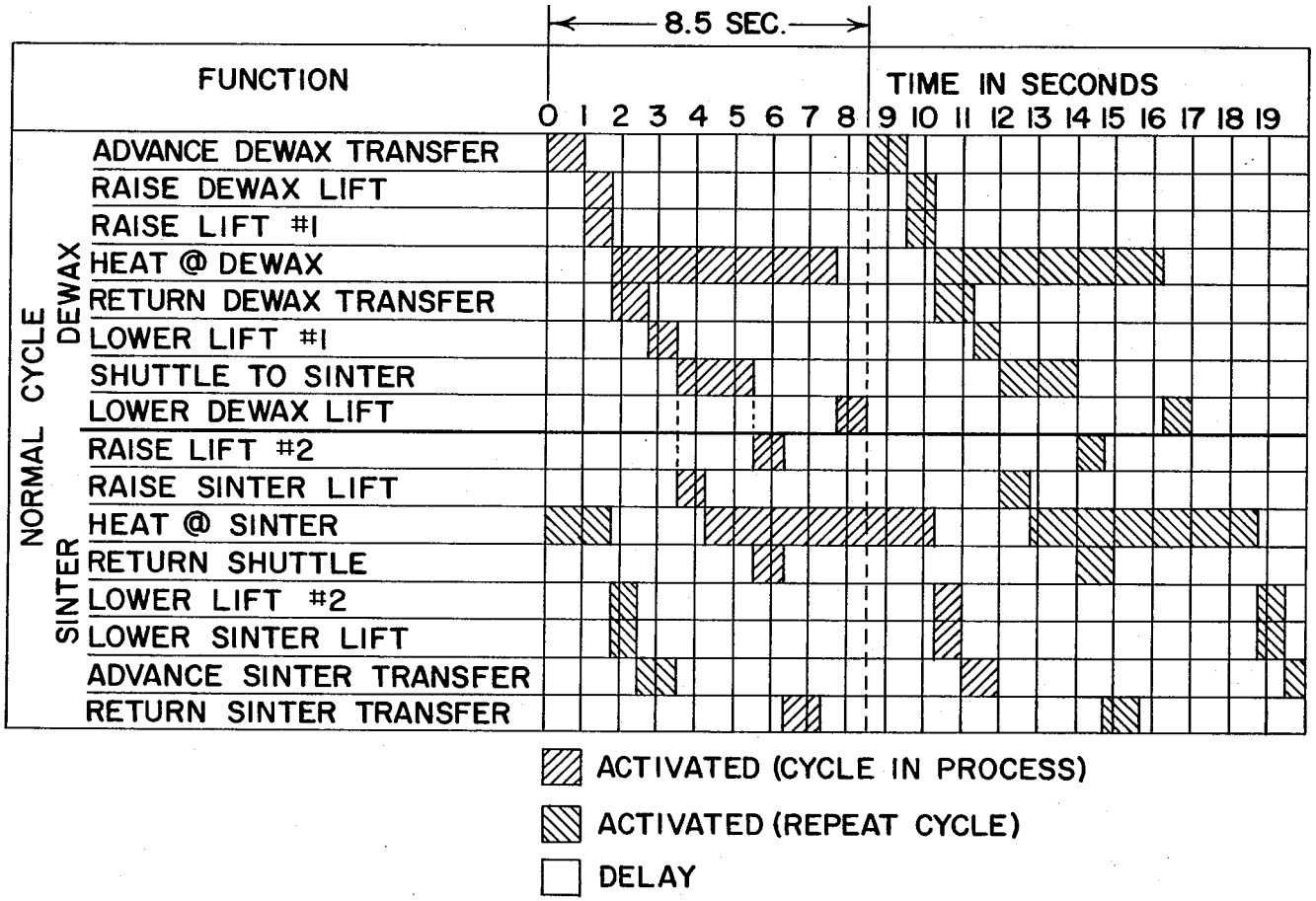
FIG. 11 is a time-function chart for the sintering apparatus.

The operation of the apparatus will be described with reference to the sequencing when workpieces are located on all the various nests of the unit taken in conjunction with the various Figures including the time function chart of FIG. 11. Therein, the workpiece adjacent the entry end of the preheating shuttle assembly 30 will have been manually or automatically located thereon from a preceeding upstream forming operation 14. Initially, the shuttle assembly 30 in the preheating zone will be reciprocated leftwardly (FIG. 2) by the rotary actuator 80. This will carry the workpieces in alignment with the induction heating units 44 in the preheating zone 20 and advance the fully preheated forwardmost workpiece on the shuttle 50 to a position overlying the transfer slide rails 162, 164. The rack and pinion drive assembly 102 is then actuated to raise the lifting bar 90, the associated lifting pods 98 and the workpieces carried thereon from the support plates 70, 71 upwardly into the heating position with the associated heating units 44. Simultaneously therewith, the first lift 154 is actuated thereby raising the workpiece thereat off the shuttle 50 to disengage the workpiece therefrom. The units 44 in the preheating zone are then energized by power supply 136 to inductively heat the workpieces thereat. At the start of the heating cycles, the shuttle 50 in the preheating zone and the shuttle 210 in the sintering zone are reversely reciprocated. During this heating cycle, the first lift 154 is retracted thereby lowering the workpiece onto the rails 162, 164 of the support plate 158. The transfer arm 170 is then reciprocated by the drive unit 172 to shift the workpiece from the receiving position on the slide rails 162, 164 to the transfer position thereon aligned with the second lift 156 and with the initial one of the heating units 214 in the sintering zone 22. Thereafter, the second lift 156 and the sintering lift assembly 212 are raised to the heating position by the linear actuator 200 and by the linear actuator 226 of drive unit 224. Upon completion of the heating cycle in the preheating zone, the lifting bar 90 is lowered by the rack and pinion drive unit 102 thereby lowering the lifting pods 98 and depositing the heated workpieces carried thereby onto the associated nests. Similarly, upon completion of the heating cycle in the sintering zone which overlaps the cycle in the preheating zone, the sintering lift assembly is lowered to deposit the heated workpieces onto the associated nests of the shuttle 210.

The preheating shuttle 50 is then actuated, after loading of an unheated workpiece at the entry thereof, to advance the next series of workpieces into alignment with the induction heating units in the preheating bank. Similarly, the next cycle of the sintering shuttle 210 will advance the workpieces from alignment with the induction heating units in the sintering bank rightwardly until the terminal workpiece carried by the extendable end shuttle 219 is located at the downstream operation 16 for manual or automatic unloading onto a downstream processing line. The second lift 156 awaits transfer of a workpiece thereto by the transfer slide 170 for the next heating cycle in the sintering zone.

In this manner, the workpieces are shuttled on a machine paced basis through the various zones for the appropriate efficient heating under controlled atmospheric conditions. It is apparent that many modifications of the above apparatus may be employed to achieve the aforementioned benefits. For instance, rather than having a generally U-shaped configuration, a single longitudinal shuttle as shown in FIG. 1A may be employed which will sequentially transfer the workpieces along the heating path for raising into heating relationship with the associated heating unit and discharging at the end thereof. The separate exhaust and blanketing environments may be employed in the various additional zones. Further, inasmuch as the heating demands in the preheating zone are less than for the sintering zone, it may be desirable to employ other heating means such as radiant heaters for raising the temperature of the workpieces prior to the sintering zone sufficient to drive off the volatiles prior to sintering.

It is claimed:

1. An apparatus for sintering compacted, unsintered powdered metallurgical workpieces containing volatile and non-volatile constituents comprising:

a plurality of inductor coils aligned in a series between an entry end and an exit end;

means for sequentially moving a workpiece into heating relationship with each of said inductor coils;

means for energizing said inductor coils when a workpiece is in heating relationship therewith, said energizing of said inductor coils being sufficient to progressively raise the temperature of the workpiece to an effective sintering temperature; and, vent means overlying a portion of the said series of inductor coils adjacent said entry end for exhausting volatile constituents expelled from the workpiece during the initial heating thereof.

2. The apparatus as recited in claim 1 including chamber means fluidly separated from said vent means and enveloping the portion of the series of said inductor coils adjacent said exit end, said chamber means maintaining a nonoxidizing environment therewithin during the sintering of the non-volatile constituents of said workpieces.

3. An apparatus for inductively heating workpieces comprising:

a plurality of serially spaced inductor means for inductively heating a workpiece in magnetically coupled relationship therewith;

shuttle means movable between a first position and a second position relative to said inductor means;

means for moving said shuttle means from said first position to said second position and back to said first position;

locating means on said shuttle means for aligning said workpieces with said inductor means in said first and second positions;

means for moving workpieces from said shuttle means into magnetically coupled relationship with said inductor means when said shuttle means is in said second position;

means for moving said shuttle means from said second position to said first position while said workpieces are in said magnetically coupled relationship;

means for energizing said inductor means when the workpieces are located in said magnetically coupled relationship; and, means for moving said workpieces from said magnetically coupled relationship with said inductor means back to said shuttle means after said shuttle means is in said first position.

4. The apparatus as recited in claim 3 wherein one of said locating means is located at a position prior to the first one of said serially spaced inductor means when said shuttle means is in said first position.

5. The apparatus as recited in claim 4 wherein one of said locating means is located at a position subsequent to the last one of said serially spaced inductor means when said shuttle means is in said second position.

6. The apparatus as recited in claim 5 wherein the one of said locating means adjacent the exit end of said shuttle means is provided with extension means for extending the position thereof relative to the other ones of said locating means as the shuttle means moves from said first position to said second position.

7. The apparatus as recited in claim 3 wherein the said serially spaced inductor means are longitudinally aligned.

8. The apparatus as recited in claim 3 wherein said locating means and said inductor means are vertically aligned in said first and second positions of said shuttle means.

9. An apparatus for sintering compacted, unsintered powdered metallurigal workpieces containing volatile and non-volatile constituents comprising:

means defining a first zone and means defining a second zone;

first shuttle means located in said first zone;

first transfer means for moving said first shuttle means horizontally between a first position and a second position within said first zone;

a plurality of first nest means on said first shuttle means for locating workpieces thereon;

a plurality of first heating means located above and aligned with said first nest means in said second position of said first shuttle means;

means for energizing said first heating means;

first lift means for raising the workpieces from said first nest means into operative heat transfer relationship with said first heating means associated therewith when the first shuttle means is in said second position and for lowering the workpieces, after predetermined heating by said first heating means, onto said first nest means when said first shuttle means is in the said first position whereby the workpieces are sequentially advanced through said first zone during movement of said first shuttle means from said first position to said second position, the cumulative predetermined heating of said workpieces by said first heating means being sufficient to expel the volatile constituents from the workpieces;

vent means enveloping said first heating means for exhausting the volatile constituents expelled from the workpieces during the heating thereof;

second shuttle means located in said second zone;

second transfer means for moving said second shuttle means horizontally between a first position and a second position within said second zone;

a plurality of second nest means on said second shuttle means for locating workpieces thereon;

third transfer means for moving workpieces from the exit end of said first zone to the entry end of the second zone;

a plurality of second heating means located above and aligned with said second nest means in said first position of said second shuttle means, each of said second heating means including an inductor coil having a conforming magnetic coupling with a workpiece positioned in heating relationship therewith;

means for energizing said second heating means when a workpiece is in said heating relationship; second lift means for raising the workpieces from the said second nest means into said heating relationship with said inductor coils when said second shuttle means is in said second position and for lowering the workpieces, after predetermined heating by said second heating means, onto said second nest means when said second shuttle is in said first position whereby the workpieces are sequentially advanced through said second zone to the exit end thereof, the cumulative predetermined heating by said second heating means being sufficient to sinter the non-volatile constituents in the workpieces; and, chamber means enveloping said inductor coils for supplying a non-oxidizing environment in said second zone.

10. The apparatus as recited in claim 9 said first zone and said second zone are parallel and said third transfer means has a first position aligned with the exit end of said first zone and a second position aligned with the initial inductor coil at the entry end of said second zone.

11. The apparatus as recited in claim 10 wherein third lift means are effective for raising workpieces from said first shuttle means at said exit end of said first zone when said first shuttle means is in said second position and for lowering the workpieces onto said third transfer means at a receiving position thereof when said first shuttle means is in said first position; and fourth lift means are effective for raising workpieces from said third transfer means into heating relationship with said initial inductor coil in said second zone when said second shuttle means is in said second position and for lowering the workpieces onto said second shuttle means when the latter is in said first position.

12. The apparatus as recited in claim 9 including rack and pinion drive means for raising and lowering said first lift means.

13. The apparatus as recited in claim 12 including rack and pinion drive means for raising and lowering said second lift means.

14. The apparatus as recited in claim 9 including rotary actuator means for moving said first shuttle means between said first position and said second position.

15. The apparatus as recited in claim 9 including rotary actuator means for moving said second shuttle means between said first position and said second position.

16. An method of sintering compacted, unsintered powdered metallurgical workpieces containing volatile and non-volatile constituents comprising the steps of:

providing a plurality of inductor coils aligned in a heating zone;

sequentially inductively coupling the workpieces to each of said plurality of inductor coils;

energizing each of said plurality of inductor coils when a workpiece is inductively coupled therewith such that each workpiece is heated upon traverse of said plurality of inductor coils to a temperature and for a time to initially expel the volatile constituents therefrom and to then effectively sinter the workpiece; and, maintaining an environment in said heating zone including fluidly separate means for initially removing the volatile constituents expelled from the workpiece and preventing oxidation of the non-volatile constituents during the sintering thereof.

17. An apparatus for sintering compacted, unsintered powdered metallurgical workpieces comprising:

a plurality of inductor coils aligned in a series between an entry end and an exit end;

means for sequentially moving a workpiece into heating relationship with said inductor coils, said workpiece moving means including workpiece lift pods having a plurality of workpiece support spokes affording support surface area contact with said workpieces; and, means for energizing said inductor coils when a workpiece is in heating relationship therewith, said energizing of said inductor coils being sufficient to progressively raise the temperature of the workpiece to an effective sintering temperature.

18. An apparatus for sintering compacted, unsintered powdered metallurgical workpieces containing volatile and non-volatile constituents, said apparatus comprising:

first and second horizontally reciprocable parallel extending shuttle means abreast one another and movable between and positionable in retracted and advanced positions to respectively advance the said workpieces step-by-step to a plurality of preheating stations and then to a plurality of sintering stations;

separate actuating means for moving respective ones of said shuttle means between and positioning them in their said retracted and advanced positions;

a plurality of serially spaced inductor means disposed in horizontally extending row arrays thereof overlying the respective said shuttle means and located at the said preheating stations and sintering stations;

separate lift means associated with said first and second shuttle means for raising the workpieces off the said shuttle means, when in their said advanced position, and into magnetically coupled relationship with the respective overlying ones of said inductor means;

means for energizing the said inductor means, while the said workpieces are held by the said lift means in their said raised, magnetically coupled relationship with the said inductor means, to thereby inductively heat the workpieces;

said separate actuating means moving the respective said shuttle means back to their retracted positions during the said inductive heating of the workpieces, and said lift means then lowering the heated workpieces back down onto the retracted respective shuttle means after the heating thereof in said inductor means;

transfer means for lifting the forwardmost one of the heated workpieces on said first shuttle means off therefrom and conveying it, after retractive movement of said first shuttle means to its retracted position by said actuating means and while the said second shuttle means is located in its said advanced position, to a position directly underlying the first one of said inductor means located at the first one of the said sintering stations; and, a transfer discharge lift means located at the said first one of said sintering stations for lifting, into magnetically coupled relationship with the said inductor means located thereat, the workpiece transferred to said first one sintering station by said transfer means, and maintaining the said transferred workpiece in said magnetically coupled relationship during the energization of said first one of said inductor means at said sintering stations concurrently with those at the others of said sintering stations.

19. The apparatus as recited in claim 18, wherein the first one of said inductor means located at the first one of said sintering stations is located abreast of the workpiece at the forwardmost end of the said first shuttle means when in its advanced position.

20. The apparatus as recited in claim 18, wherein the said transfer means comprises a pair of transfer slide rails extending laterally between the workpiece discharge end of said first shuttle means when in its advanced position and the workpiece acceptor end of said second shuttle means when in its retracted position; and, a transfer receiver lift means located at the transfer station at which the forwardmost one of the workpieces carried by the first shuttle means is positioned when the first shuttle means is located in its said advanced position, for raising the said forwardmost workpiece off the said advanced first shuttle means and, after subsequent movement of said first shuttle means to its retracted position by said actuating means, then lowering the said forwardmost workpiece down onto the said transfer slide rails.

21. The apparatus as recited in claim 20, wherein the said transfer means includes a slide member mounted for reciprocating movement in a direction along said slide rails for engaging with the said forwardmost one of the said workpieces, after the lowering thereof onto the said slide rails by said transfer receiver lift means, and sliding the said forwardmost workpiece along the slide rails to a position thereon underneath and vertically aligned with the one of said inductor means located at the first one of the said sintering stations.

22. The apparatus as recited in claim 21, wherein both the said first and second shuttle means on which the said workpieces are supported during their step-by-step advance movement to the said preheating and sintering stations are provided with locating nests within which the respective workpieces are seated to locate them in vertically aligned relation with the said inductor means in the advanced position of the said shuttle means, and the said shuttle means are provided with openings to permit the vertical passage through said shuttle means of the said lift means and of the said transfer discharge and receiver lift means, when the said nests are vertically aligned with said inductor means.

23. The apparatus as recited in claim 18, wherein the said actuating means for moving the said shuttle means between their retracted and advanced positions advances the sintered workpieces toward an associated workpiece press forming operation at a rate paced with the operating cycle thereof.

* * * * *